US007708601B2

(12) United States Patent
Tanaka

(10) Patent No.: US 7,708,601 B2
(45) Date of Patent: May 4, 2010

(54) CONNECTOR

(75) Inventor: Yukitaka Tanaka, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/388,774

(22) Filed: Feb. 19, 2009

(65) Prior Publication Data

US 2009/0209119 A1 Aug. 20, 2009

(30) Foreign Application Priority Data

Feb. 20, 2008 (JP) ..... 2008-039039

(51) Int. Cl.
*H01R 24/00* (2006.01)

(52) U.S. Cl. ..... 439/660

(58) Field of Classification Search ..... 439/660, 439/79, 80

See application file for complete search history.

(56) References Cited

U.S. PATENT DOCUMENTS 6,036,506 A * 3/2000 Korsunsky ..... 439/79
6,935,870 B2 8/2005 Kato et al.
7,303,410 B2 * 12/2007 Saito ..... 439/108

FOREIGN PATENT DOCUMENTS

JP 2002-334748 A 11/2002

* cited by examiner

*Primary Examiner*—Phuong K Dinh
(74) *Attorney, Agent, or Firm*—Frishauf, Holtz, Goodman & Chick, P.C.

(57) ABSTRACT

A connector reduced in depth dimension. Contact portions of first and second signal contacts and ground contacts for high-speed transmission are arranged in a housing in a row in a contact arranging direction orthogonal to a fitting/removing direction, and contact portions of contacts for non-high-speed transmission are arranged in the housing in a row in the contact arranging direction below the contact portions of the first and second signal contacts and the ground contacts. Terminal portions of the first and second signal contacts and the ground contacts are arranged in a row in the contact arranging direction, and press-fitting portions of the contracts for non-high-speed transmission are press-fitted in the housing along the direction of height of the housing, whereby they are disposed between the contacts portions and the terminal portions of the first and second signal contacts and the ground contacts.

10 Claims, 12 Drawing Sheets

CONNECTOR

BACKGROUND OF THE INVENTION

1. Field of the Invention

This invention relates to a connector, more particularly to a connector which is reduced in depth dimension.

2. Description of the Related Art

Conventionally, there has been proposed a connector which is provided with a plurality of L-shaped contacts and an insulator holding the contacts, and is mounted on a printed board (see Japanese Laid-Open Patent Publication (Kokai) No. 2002-334748).

The insulator has a fitting portion for fitting to a mating connector. Each L-shaped contact has a contact portion, a held portion, and a terminal portion. The contact portion extends in a fitting direction in which the insulator is fitted to the mating connector. The contact portions are arranged in the fitting portion of the insulator in two rows one above the other in a contact arranging direction. The held portion is continuous with the contact portion, extends in a direction in which the connector is fitted, and is held in the insulator. The terminal portion is soldered to a through hole in the printed board.

In general, the held portion of the L-shaped contact is press-fitted in the insulator along the fitting direction of the connector.

In the connector having L-shaped contacts, the held portions of the contacts extending in the fitting direction of the connector are held by the insulator, and hence it is impossible to obtain a sufficient holding force for holding the held portions of the contacts, unless holding portions of the insulator which hold the held portions of the contacts have a length (in the fitting direction) not shorter than a predetermined length.

In the case of the above-described connector in which the contact portions of the L-shaped contacts are arranged in two rows one above the other, it is necessary to make the length of the held portions of contacts of the upper row longer than that of the held portions of contacts of the lower row, because if the length of the held portions of contacts of the upper row is equal to that of the held portions of contacts of the lower row, the terminal portions of the contacts of the upper row and those of the contracts of the lower row come into contact with each other. Further, the respective lengths of holding portions of the insulator for holding the held portions of the contacts are determined by setting the length of a holding portion of the insulator for holding the held portions of the contacts of the lower row to a reference length as a shortest required length, and hence the length of a holding portion of the insulator for holding the held portions of the contacts of the upper row becomes longer than the reference length. The lengths of holding portions of the insulator are thus determined because if the length of the holding portion of the insulator for holding the held portions of the contracts of the upper row is set to the reference length, the length of the holding portion for holding the held portions of the contacts of the lower row becomes too short to secure a sufficient holding force for holding the contacts.

Therefore, the conventional connector suffers from the problem that the holding portion of the insulator for holding the held portions of the contacts of the upper row becomes long, increasing the depth dimension in the direction of the depth of the connector.

SUMMARY OF THE INVENTION

The present invention has been made in view of these circumstances, and an object thereof is to provide a connector which is reduced in depth dimension.

To attain the above object, the present invention provides a connector comprising a housing that is capable of being fitted to a mating housing of a mating connector, and a plurality of L-shaped contacts that are held by the housing, the plurality of L-shaped contacts including first contacts and second contacts, wherein each of the first contacts and the second contacts has a contact portion which is capable of being brought into contact with a mating contact of the mating connector, a connection portion which is connected to an object to be connected, and a fixing portion which is fixed to the housing, wherein the contact portions of the first contacts are arranged in at least one row in a contact arranging direction which is orthogonal to a connector fitting direction, wherein the contact portions of the second contacts are arranged in at least one row in the contact arranging direction, wherein the row formed by the contact portions of the first contacts, and the row formed by the contact portions of the second contacts are parallel to each other, wherein the row formed by the contact portions of the first contacts is disposed upward in a direction of height of the housing which is orthogonal to both the connector fitting direction and the contact arranging direction, with respect to the row formed by the contact portions of the second contacts, wherein the connection portions of the first contacts are arranged in at least one row in the contact arranging direction, wherein the connection portions of the second contacts are arranged in at least one row in the contact arranging direction, wherein the row formed by the connection portions of the first contacts and the row formed by the connection portions of the second contacts are parallel to each other, wherein the row formed by the connection portions of the first contacts is disposed rearward in the connector fitting direction with respect to the row formed by the connection portions of the second contacts, and wherein the fixing portions of the second contacts are disposed between the contact portions of the first contacts and the connection portions of the first contacts in the connector fitting direction, and are press-fitted in the housing along the direction of height of the housing.

With the arrangement of the connector according to the present invention, the fixing portions of the second contacts are disposed between the contact portions of the first contacts and the connection portions of the first contacts in the connector fitting direction, and are press-fitted in the housing along the direction of height of the housing. This makes it possible to shorten the length of the second contacts in the connector fitting direction, and shorten the length of the first contacts in the connector fitting direction. As a result, the dimension in the direction of depth of the housing is reduced.

Preferably, the connection portions of the first contacts each have a planar shape of a surface-mounting type, and the connection portions of the second contacts each have a pin shape of a through hole insertion type.

More preferably, the connection portions of the first contacts each protrude out of the housing.

Preferably, the housing has recesses formed therein, and the second contacts have engaging portions formed for engagement with the recesses, respectively.

Preferably, the first contacts are contacts for high-speed transmission, and the second contacts are contacts for non-high-speed transmission.

More preferably, the contacts for high-speed transmission include pairs of signal contacts for high-speed transmission, and ground contracts for high-speed transmission, and the connection portions of the pairs of signal contacts for high-speed transmission are disposed between the connection portions of ones of the ground contacts for high-speed transmission which are adjacent in the contact arranging direction.

Further preferably, the connection portions of the contacts for non-high-speed transmission are in staggered arrangement in the contact arranging direction.

According to this invention, it is possible to reduce the dimension of the connector in the direction of the depth thereof The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Referring to FIGS. 1A to 2B, a connector 1 is comprised of a housing 3, a plurality of contacts 5, and a shell 7.

Figure 1A:
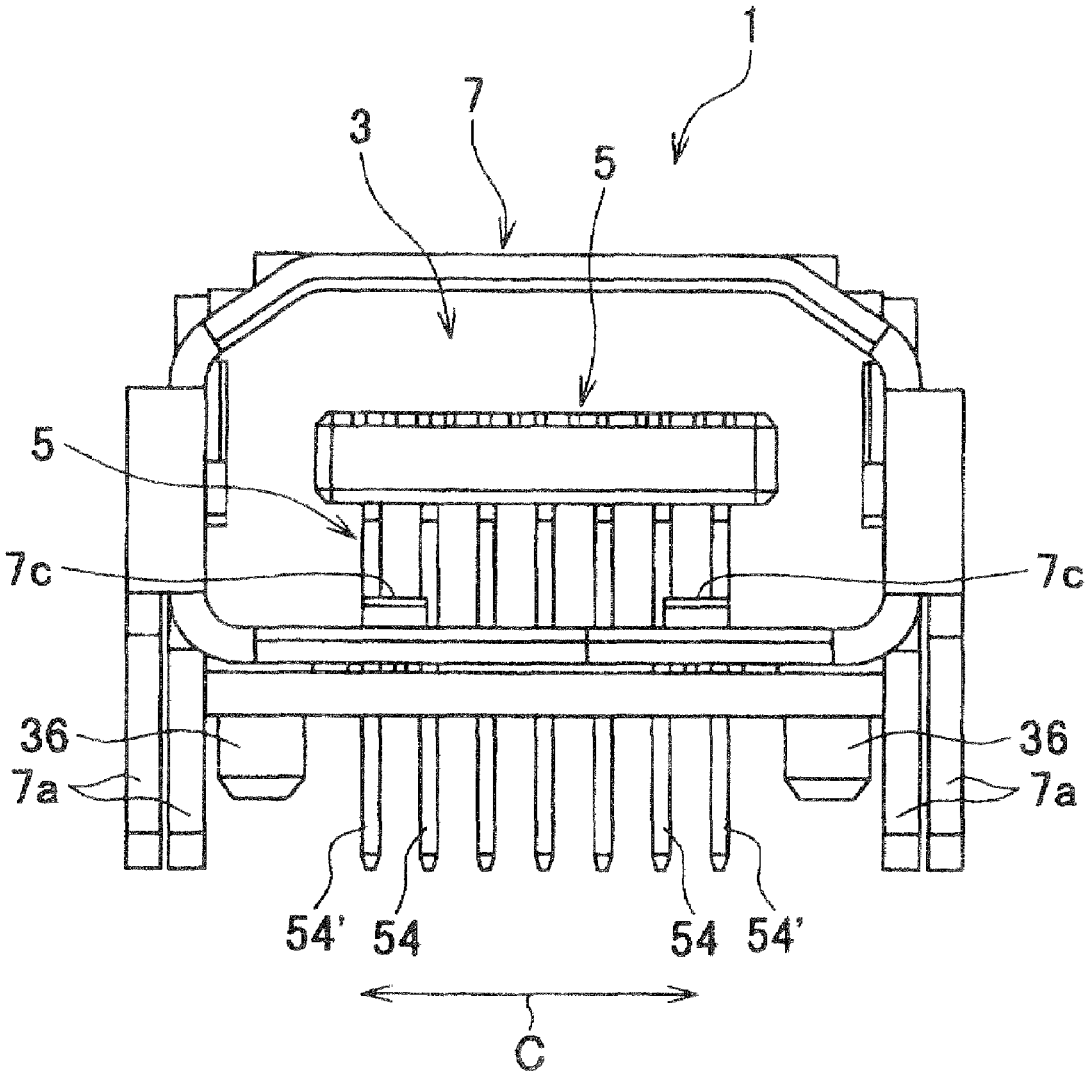
FIG. 1A is a front view of a connector according to a first embodiment of the present invention.
Figure 1B:
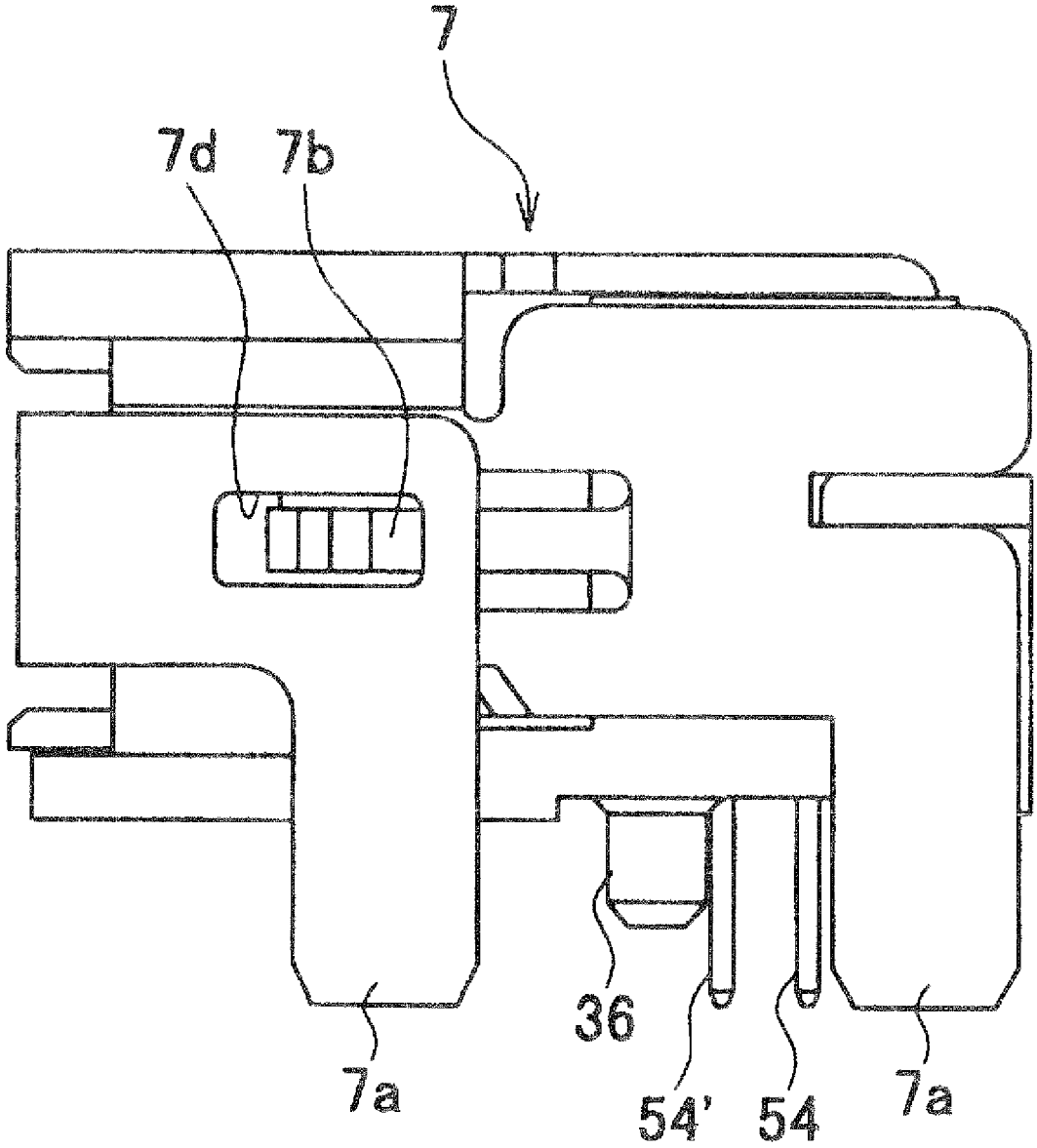
FIG. 1B is a side view of the connector.
Figure 1C:
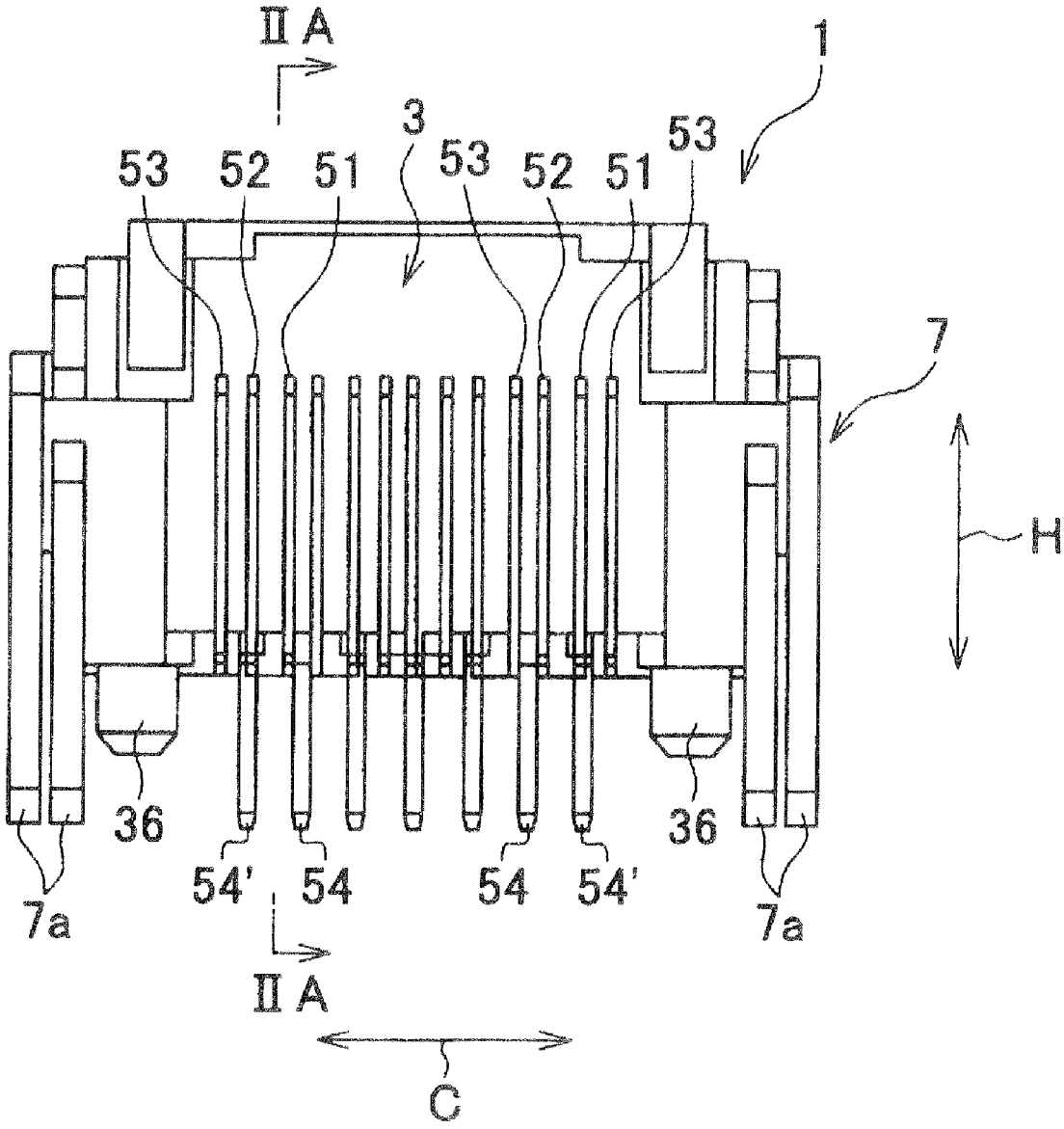
FIG. 1C is a rear view of the connector.
Figure 1D:
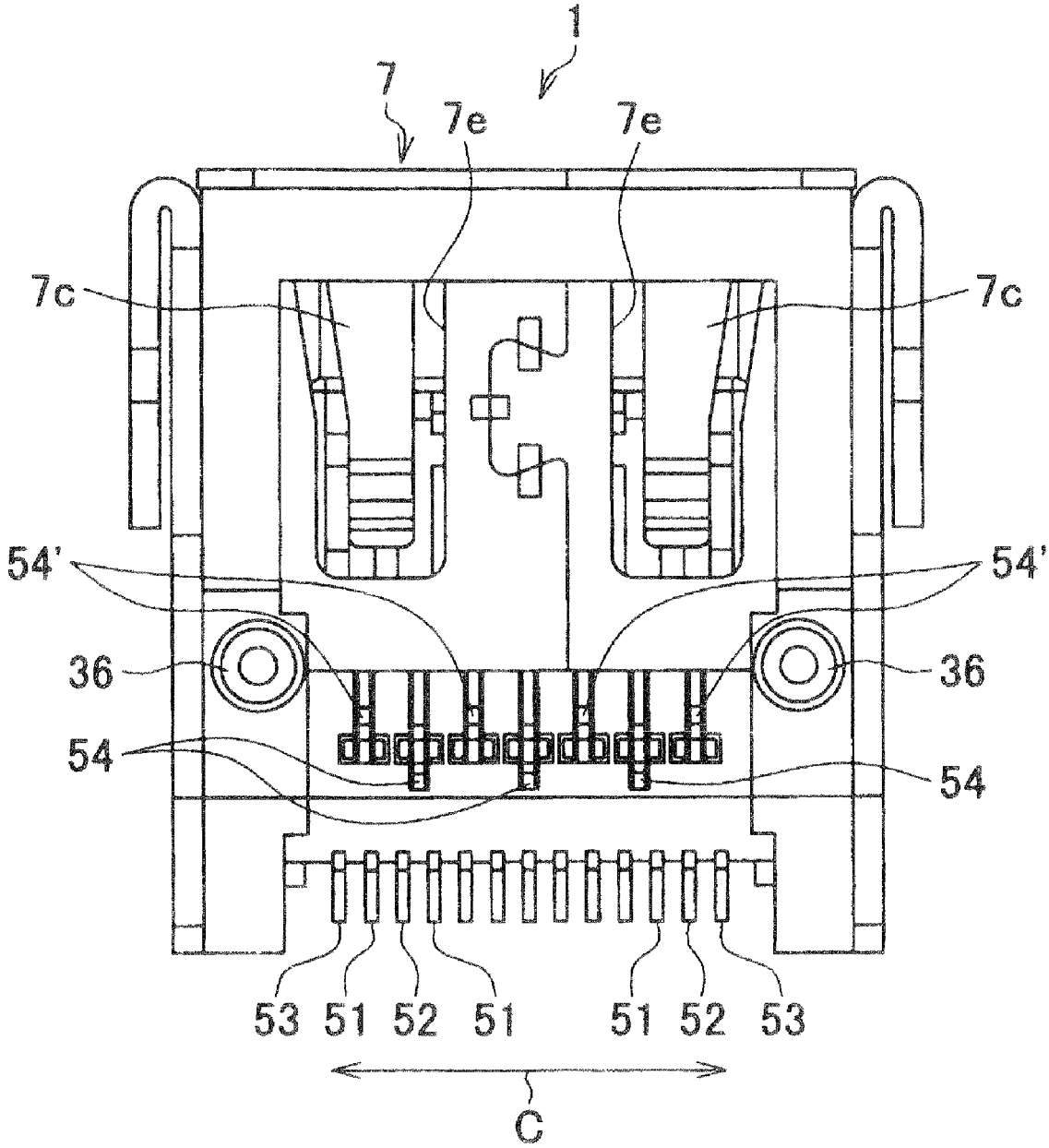
FIG. 1D is a bottom view of the connector.
Figure 2A:
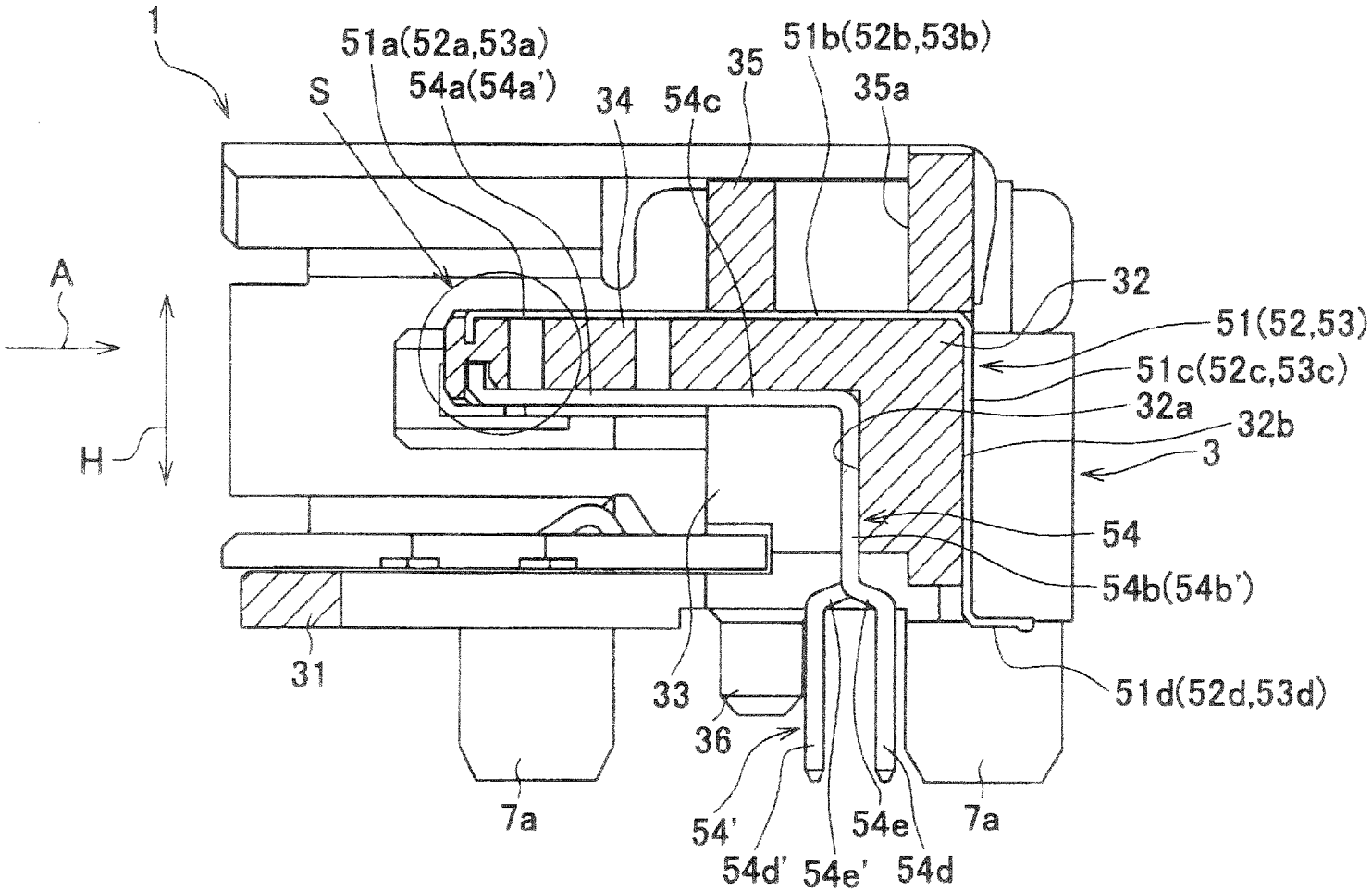
FIG. 2A is a cross-sectional view taken on line IIA-IIA of FIG. 1C.
Figure 6:
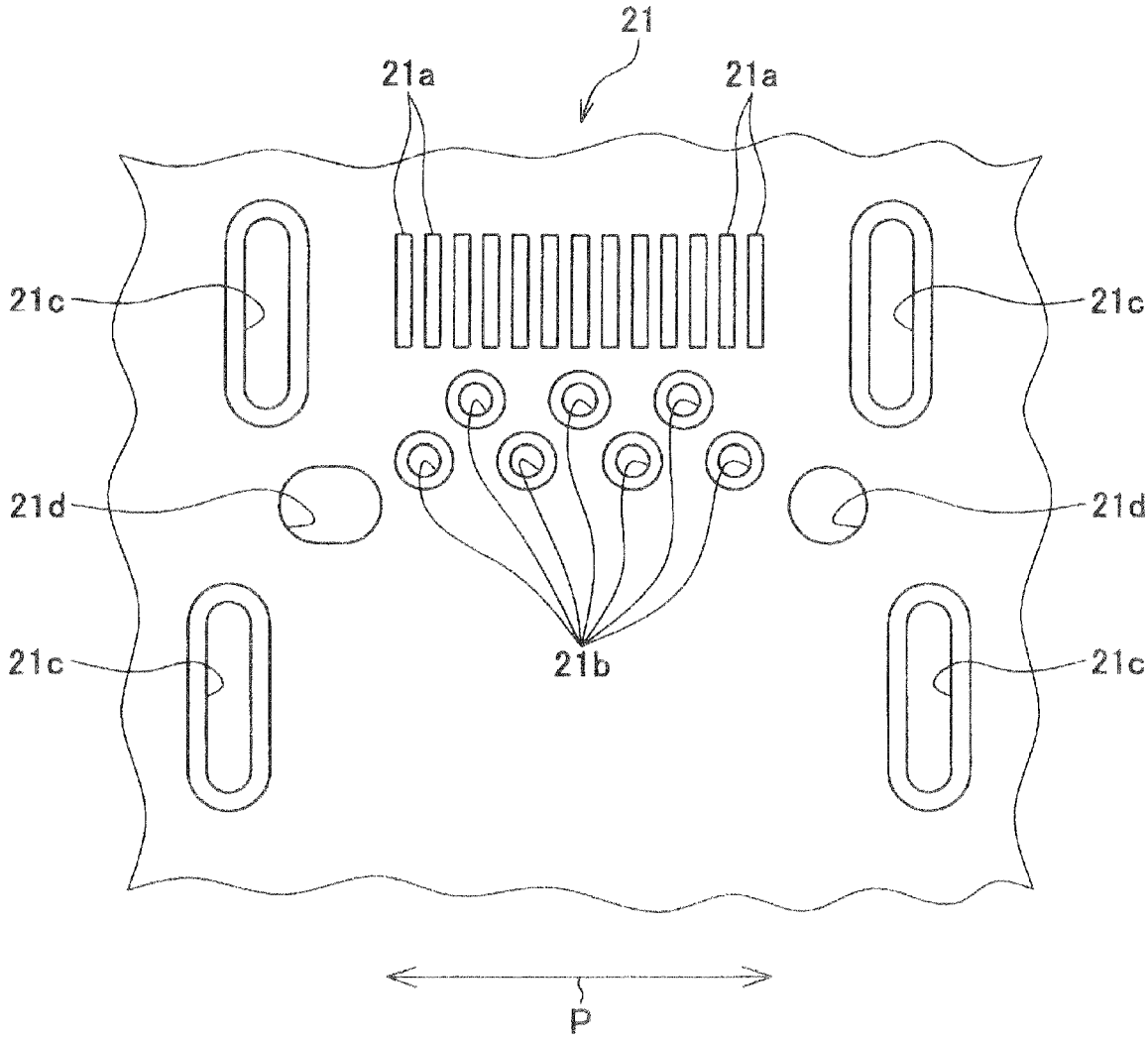
FIG. 6 is a plan view of part of a printed board on which the connector shown in FIGS. 1A to 1D are mounted.

The housing 3 is made of a resin having insulation properties. As shown in FIG. 2A, the housing 3 includes a bottom board 31, a rear wall portion 32, side wall portions 33, a holding portion 34, and a projecting portion 35. The bottom board 31 has a plate-like shape, and has a bottom surface formed with a pair of positioning bosses 36. The positioning bosses 36 are inserted in positioning holes 21*d* of a printed board 21 (object to be connected), shown in FIG. 6. The rear wall portion 32 is continuous with the rear of the bottom board 31. The rear wall portion 32 has a front-side surface (inner surface) thereof formed with a plurality of press-fitting grooves 32*a*, and a rear-side surface (outer surface) thereof formed with a plurality of press-fitting grooves 32*b*, at equally-spaced intervals, respectively. The press-fitting grooves 32*a* and 32*b* extend in a direction H of the height of the housing 3 (direction orthogonal to a contract arranging direction C and a fitting/removing direction A). Two side wall portions 33 are continuous with the opposite sides of the rear wall portion 32. The holding portion 34 has a plate-like shape, and is continuous with the rear wall portion 32. The holding portion 34 extends along the fitting/removing direction A (connector fitting direction) in which the housing 3 is fitted in and removed from a mating housing of a mating connector, not shown, and is parallel to the bottom board 31. The holding portion 34 has recesses 34*a* formed in a lower surface of a front end thereof (see FIG. 2B). The projecting portion 35 is continuous with the rear wall portion 32, both of the side wall portions 33, and the holding portion 34. The projecting portion 35 has a hole 35*a* formed therein for adjusting the impedance value.

The contact 5 includes contacts (first contacts) for high-speed transmission, and contacts (second contacts) 54, 54' for non-high-speed transmission. The contacts for high-speed transmission includes first signal contacts (signal contacts for high-speed transmission) 51, second signal contacts (signal contacts for high-speed transmission) 52, and ground contacts (ground contacts for high-speed transmission) 53. These contacts 51, 52, and 53 are disposed at predetermined space intervals in the housing 3. The contacts 54 for non-high-speed transmission and the contacts 54' for non-high-speed transmission are alternately arranged in the housing 3 at equally-spaced intervals. One first signal contact 51 and one second signal contact 52 form a pair of signal contacts for high-speed transmission. A pair of signal contacts 51, 52 for high-speed transmission, and one ground contact 53 form one contact group for differential signal transmission.

As shown in FIG. 2A, each first signal contact 51 has a contact portion 51*a*, a fixing portion 51*b*, a connecting portion 51*c*, and a terminal portion (connection portion) 51*d*, and is formed by blanking and bending a metal plate having elasticity. The contact portions 51*a* are brought into contact with mating contact portions of mating contacts, not shown. The contact portions 51*a* are disposed on the upper surface of the holding portion 34. The fixing portion 51*b* is embedded the housing 3 by a so-called mold-in method. The connecting portion 51*c* connects the fixing portion 51*b* and the terminal portion 51*d*. The terminal portion 51*d* is continuous with the connecting portion 51*c*. The terminal portion 51*d* has a planar shape of a surface-mounting type and is soldered to a pad 21*a* (see FIG. 6) on the printed board 21.

The second signal contact 52 has the same shape as the first signal contact 51, and hence reference numerals associated with the second signal contact 52 (52, 52*a* to 52*d*) are shown in parentheses beside reference numerals associated with the first signal contact 51 (51, 51*a* to 51*d*), and illustration of the second signal contacts 52 is omitted from FIG. 2A. Each second signal contact 52 has a contact portion 52*a*, a fixing portion 52*b*, a connecting portion 52*c*, and a terminal portion (connection portion) 52*d*, and is formed by blanking and bending a metal plate having elasticity. The contact portions 52*a* are brought into contact with the mating contact portions of the mating contacts. The contact portions 52*a* are disposed on the upper surface of the holding portion 34. The fixing portion 52*b* is embedded in the housing 3 by the so-called mold-in method. The connecting portion 52*c* connects the fixing portion 52*b* and the terminal portion 52*d*. The terminal portion 52*d* is continuous with the connecting portion 52*c*. The terminal portion 52*d* is soldered to the pad 21*a* (see FIG. 6) on the printed board 21.

The ground contact 53 has the same shape as the first signal contact 51, and hence reference numerals associated with the ground contact 53 (53, 53*a* to 53*d*) are shown in parentheses beside the reference numerals associated with the first signal contact 51 (51, 51*a* to 51*d*), and illustration of the ground contacts 53 is omitted from FIG. 2. Each ground contact 53 has a contact portion 53*a*, a fixing portion 53*b*, a connecting portion 53*c*, and a terminal portion (connection portion) 53*d*, and is formed by blanking and bending a metal plate having elasticity. The contact portions 53*a* are brought into contact with mating contact portions of mating contacts. The contact portions 53*a* are disposed on the upper surface of the holding portion 34. The fixing portion 53*b* is embedded in the housing 3 by the so-called mold-in method. The connecting portion 53*c* connects the fixing portion 53*b* and the terminal portion 53*d*. The terminal portion 53*d* is continuous with the connecting portion 53*c*. The terminal portion 53*d* is soldered to the pad 21*a* (see FIG. 6) on the printed board 21.

Figure 2B:
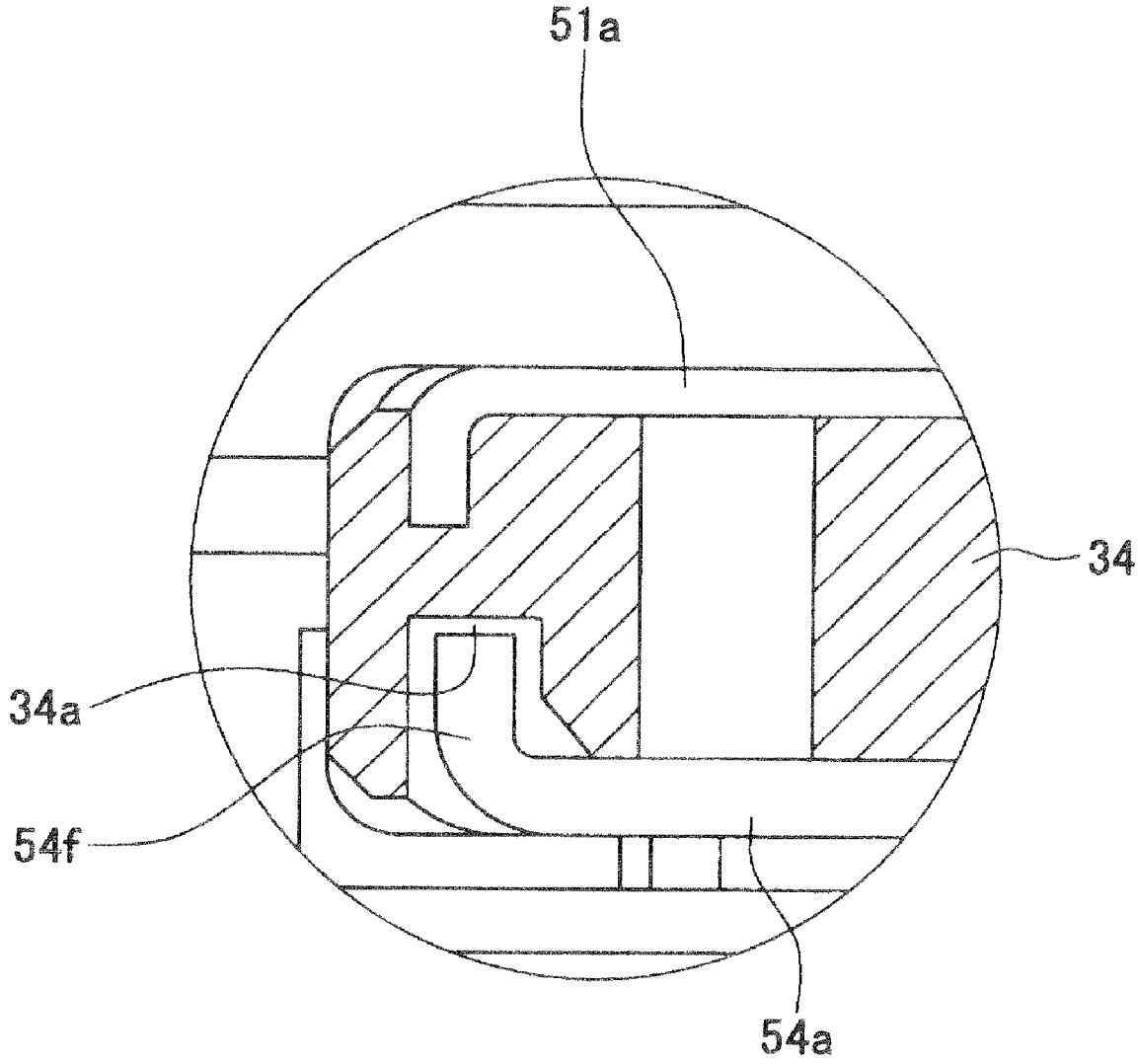
FIG. 2B is an expanded view of an S portion appearing in FIG. 2A.

As shown in FIGS. 2A and 2B, each contact 54 for non-high-speed transmission has a contact portion 54*a*, a press-fitting portion (fixing portion) 54*b*, a connecting portion 54*c*, a terminal portion (connection portion) 54*d*, an position changing portion 54*e*, and a disconnection prevention portion (engaging portion) 54*f*. The contact portions 54*a* are brought into contact with mating contact portions of mating contacts. The contact portions 54*a* are disposed on the lower surface of the holding portion 34. The press-fitting portion 54*b* is press-fitted in a associated one of the press-fitting grooves 32*a* of the housing 3. The connecting portion 54*c* connects the contact portion 54*a* and the press-fitting portion 54*b*. The terminal portion 54*d* has a pin shape of a through hole insertion type, and is inserted into a through hole 21*b* (see FIG. 6) of the printed board 21, and is soldered thereto. The position changing portion 54*e* connects the press-fitting portion 54*b* and the terminal portion 54*d*. The position changing portion 54*e* is bend rearward, and changes the position (position in the fitting/removing direction A) of the terminal portion 54*d* with respect to the press-fitting portion 54*b*. The terminal portion 54*d* is located rearward of the press-fitting portion 54*b*. The disconnection prevention portion 54*f* is engaged with an associated one of the recesses 34*a* of the holding portion 34, and is fixed to the holding portion 34 e.g. by an adhesive (see FIG. 2B).

The contact 54' for non-high-speed transmission has a similar configuration as the contact 54 except an position changing portion 54*e*'. The position changing portion 54*e*' is folded forward to thereby cause a terminal portion 54*d*' to be positioned forward of the press-fitting portion 54*b*. As a result, the terminal portions 54*d* and 54*d*' are in staggered arrangement (see FIG. 4). Therefore, if the terminal portions 54*d* and 54*d*' are connected by imaginary straight lines, one zigzag line is formed in which mountain-like shapes each in bilateral symmetry are connected in the contact arranging direction C. The terminal portions 54*d*, 54*d*' are inserted into the respective associated through holes 21*b* of the printed board 21, and are soldered thereto. The through holes 21*b* in the printed circuit board 21 are in staggered arrangement matching the staggered arrangement of the terminal portions 54*d*, 54*d*' (see FIG. 6).

Figure 5A:
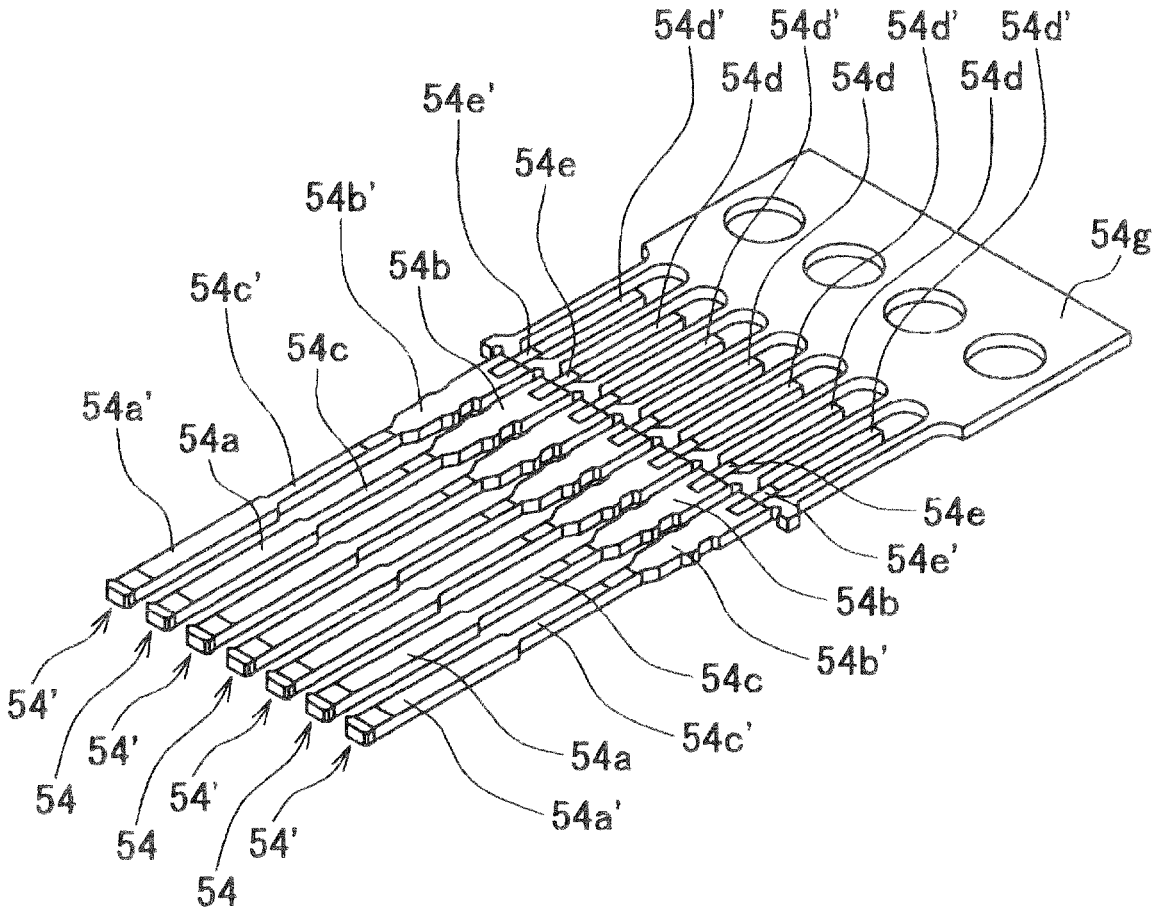
FIG. 5A is a perspective view of a developed shape of contacts for non-high-speed transmission appearing in FIGS. 1A to 1D.
Figure 5B:
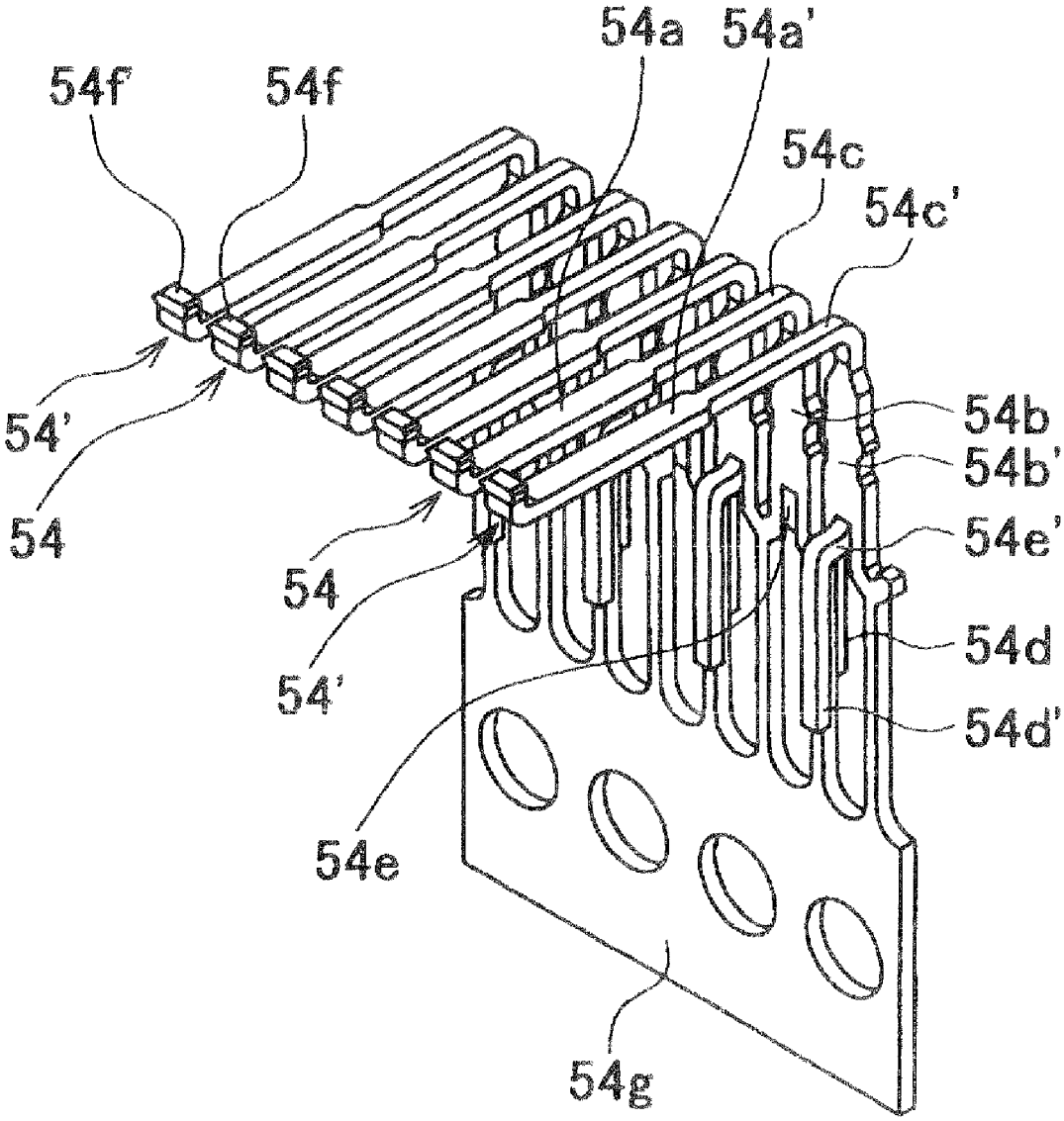
FIG. 5B is a perspective view of a bent state of the contacts shown in FIG. 5A.
Figure 5C:
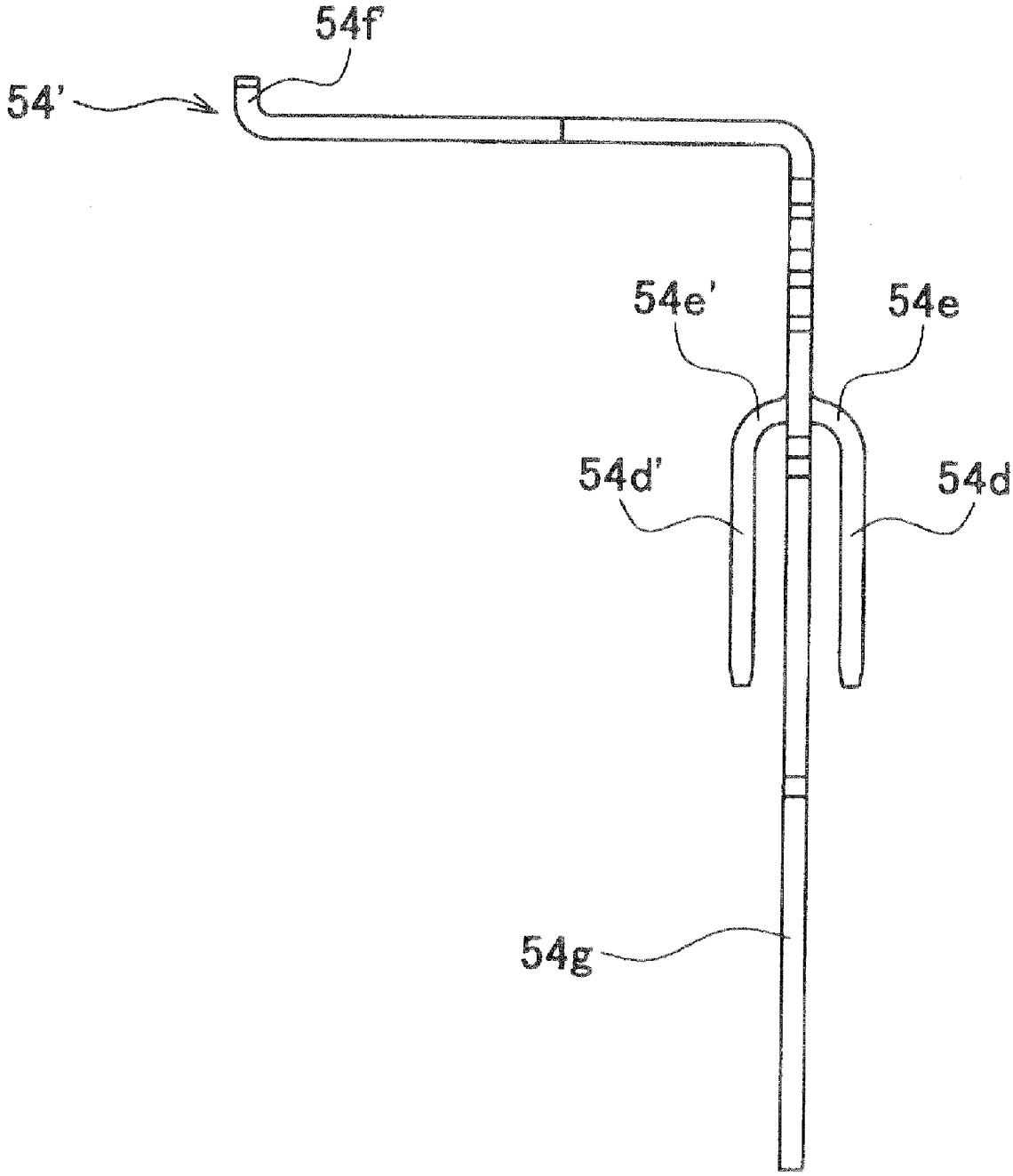
FIG. 5C is a perspective view of the contacts shown in FIG. 5B.

As shown in FIGS. 5A to 5C, the contacts 54 and 54' are formed by blanking and bending a metal plate having elasticity. The lengths of the contacts 54 and 54' in the developed state are equal to each other, which makes it easy to perform bending after blanking. The blanked contacts 54 and 54' are continuous with a carrier 54*g*.

When performing bending, the position changing portion 54*e* of the contact 54 is bent in a predetermined direction, and the position changing portion 54*e*' of the contact 54' is bent in an opposite direction to the predetermined direction (see FIG. 5C). Even after bending, the contacts 54 and the contacts 54' are continuous with the carrier 54*g*. This makes it possible to press-fit the contacts 54 and the contacts 54' in the press-fitting groove 32*a* along the direction of the height H of the housing 3 at a time. After press-fitting the press-fitting portions 54*b*, 54*b*' of the contacts 54, 54' in the press-fitting groove 32*a*, the carrier 54*g* is cut off from the contacts 54 and 54'.

The shell 7 is made of a metal and, as shown in FIGS. 1A to 1D, has leg parts 7*a*, contact parts 7*b*, and locking pieces 7*c*. The leg parts 7*a* are soldered to through holes 21*c* of the printed board 21 (see FIG. 6), and are grounded. The contact parts 7*b* are brought into contact with a mating shell, not shown, of the mating connector via window holes 7*d* formed in side walls of the shell 7. The locking pieces 7*c* are disposed within holes 7*e* formed in the bottom of the shell 7. The locking pieces 7*c* are engaged with the mating shell of the mating connector, to thereby lock the mating shell to the shell 7.

Figure 3:
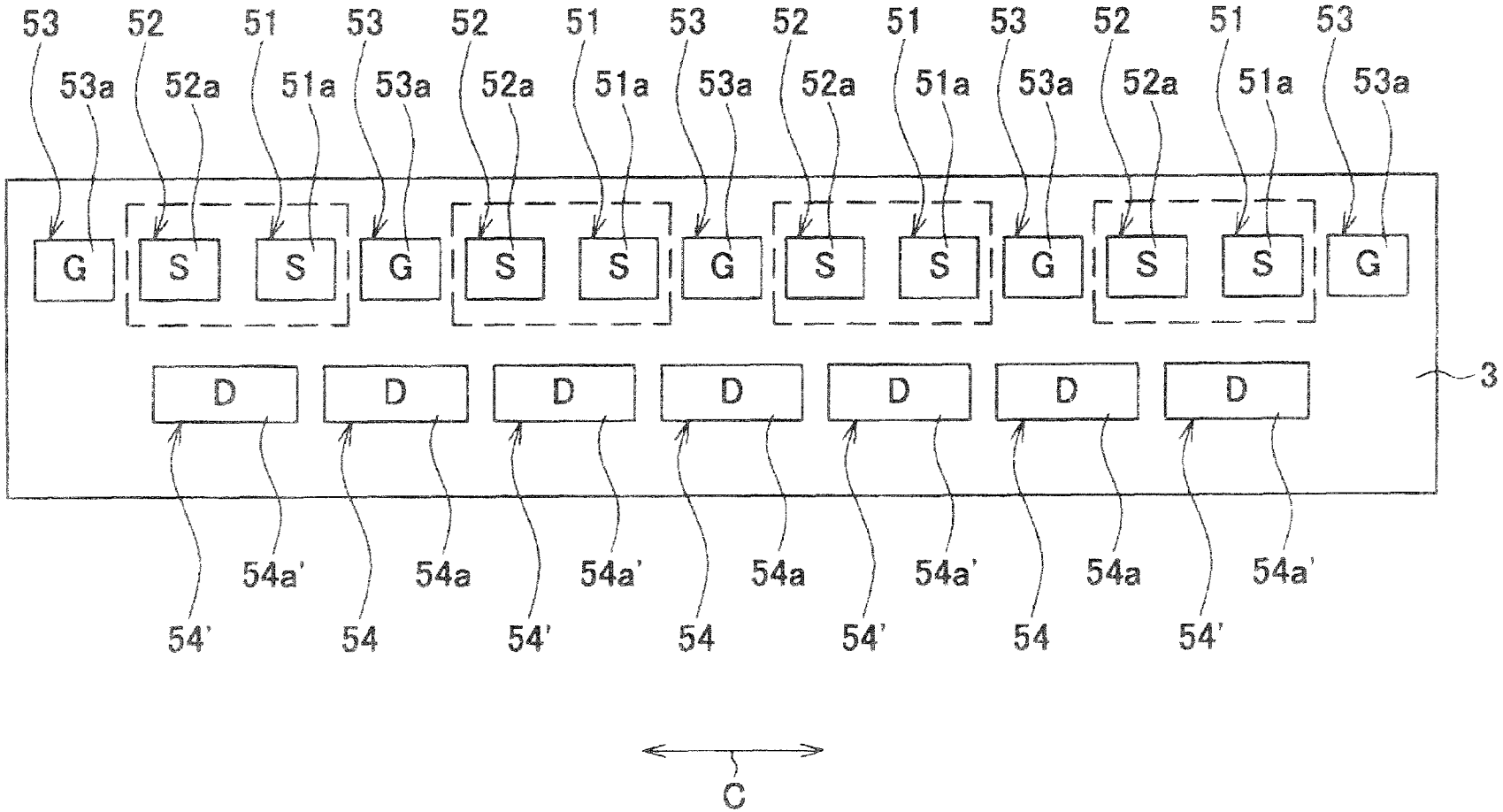
FIG. 3 is a perspective view of an arrangement of contact portions of contacts of the connector shown in FIGS. 1A to 1D.

As shown in FIG. 3, the contact portions 51*a* and 52*a* of the first and second signal contacts 51 and 52, and the contact portions 53*a* of the ground contacts 53 are arranged in a row in the contact arranging direction C which is orthogonal to the fitting/removing direction A, respectively.

The contact portions 54*a* and 54*a*' of the contacts 54 and 54' are also arranged in a row in the contact arranging direction C.

The row formed by the contact portions 51*a* and 52*a* of the first and second signal contacts 51 and 52, and the contact portions 53*a* of the ground contacts 53, and the row formed by the contact portions 54*a* and 54*a*' of the contacts 54 and 54' are parallel to each other.

The contact portions 51*a* and 52*a* of each pair of first and second signal contacts 51 and 52 are disposed between the contact portions 53*a* of adjacent ones of the ground contacts 53 in the contact arranging direction C. A pitch of the first and second signal contacts 51 and 52 and the ground contacts 53 in the contact arranging direction C in their row and a pitch of the contacts 54 and 54' in the contact arranging direction C in their row are different from each other.

Figure 4:
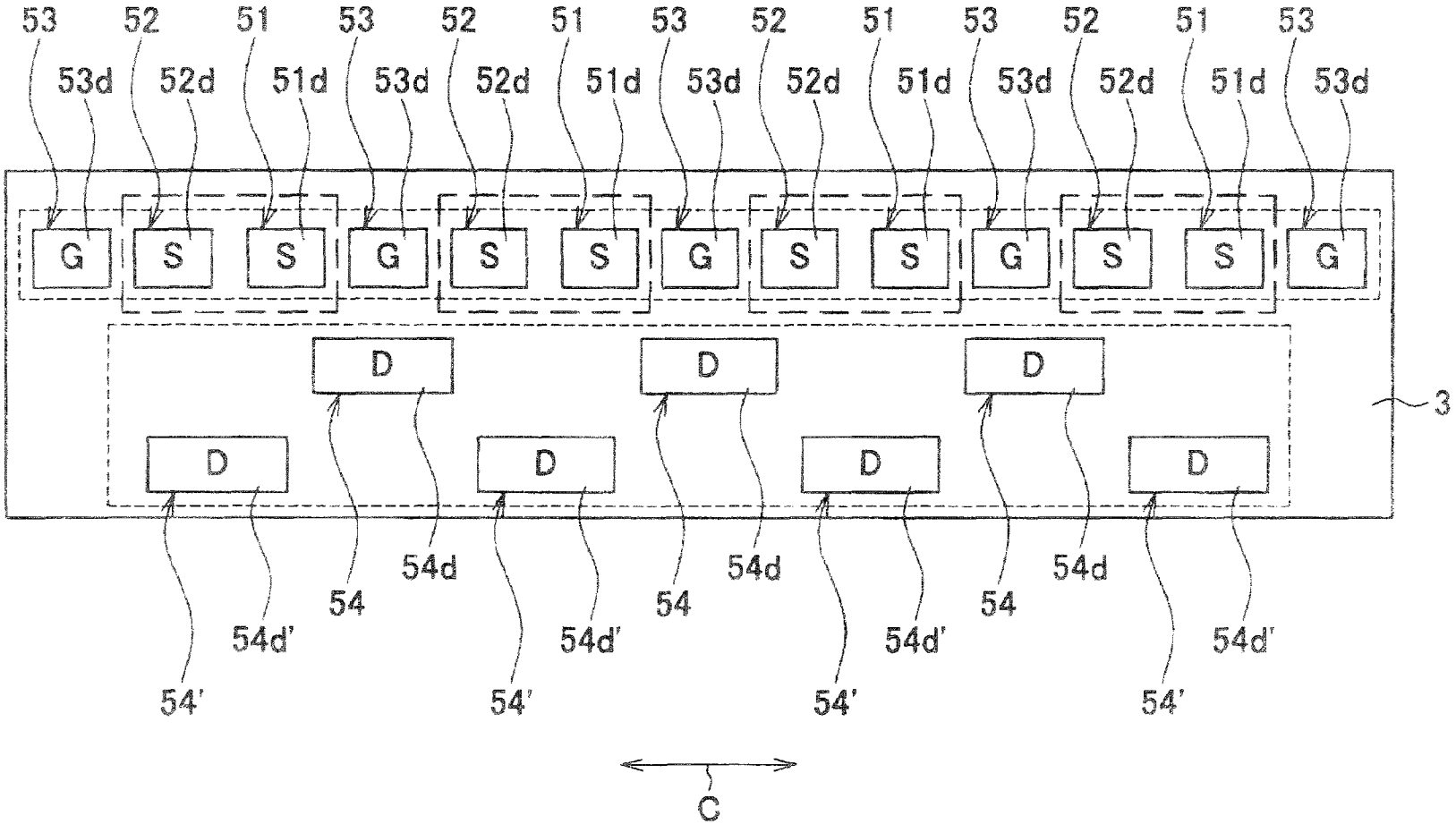
FIG. 4 is a perspective view of an arrangement of terminal portions of the contacts of the connector shown in FIGS. 1A to 1D.

As shown in FIG. 4, the terminal portions 51*d* and 52*d* of the first and second signal contacts 51 and 52, and the terminal portions 53*d* of the ground contacts 53 are arranged in a row in the contact arranging direction C.

The terminal portions 51*d* and 52*d* of each pair of first and second signal contacts 51 and 52 are disposed between adjacent ones of the terminal portions 53*d* of the ground contacts 53 in the contact arranging direction C.

The terminal portions 54*d* and 54*d*' of the contacts 54 and 54' are arranged in two rows in the contact arranging direction C. The row formed by the terminal portions 51*d* and 52*d* of the first and second signal contacts 51 and 52, and the terminal portions 53*d* of the ground contacts 53, and the two rows formed by the terminal portions 54*d* and 54*d*' of the contacts 54 and 54' are parallel to each other. The terminal portions 54*d* of the contacts 54 and the terminal portions 54*d*' of the contacts 54', which form the two rows, are arranged in a staggered manner in the contact arranging direction C. Therefore, if the terminal portions 54*d* and 54*d*' are connected by imaginary straight lines, one zigzag line is formed in which mountain-like shapes each in bilateral symmetry are connected in the contact arranging direction C.

As described above, according to the present embodiment, the press-fitting portions 54*b*, 54*b*' of the contacts 54, 54' are disposed between the contact portions 51*a*, 52*a*, 53*a* and the terminal portions 51*d*, 52*d*, 53*d* of the contacts 51, 52, 53, and are press-fitted in the housing 3 along the direction of the height of the housing 3. Therefore, it is possible to shorten the length of the contacts 54, 54' in the fitting/removing direction A, and shorten the length of the contacts 51, 52, 53 in the fitting/removing direction A. As a result, the depth dimension of the housing 3 is reduced, and hence the depth dimension of the connector is also reduced.

Further, the contact portions 51*a* and 52*a* of the first and second signal contacts 51 and 52 for high-speed transmission, and the contact portions 53*a* of the ground contacts 53 for high-speed transmission are arranged in a row in the contact arranging direction C, and the contact portions 51*a* and 52*a* of each pair of first and second signal contacts 51 and 52 are disposed between the contact portions 53*a* of the adjacent ground contacts 53 in the contact arranging direction C. This suppresses variation in transmission characteristics or crosstalk between each pair of first and second signal contacts and other pairs of first and second signal contacts, whereby it is possible to prevent degradation in transmission.

Furthermore, the terminal portions 51*d* and 52*d* of each pair of first and second signal contacts 51 and 52 are disposed between the terminal portions 53*d* of adjacent ones of the ground contacts 53 in the contact arranging direction C. This suppresses crosstalk between the terminal portions 51*d* and 52*d* of each pair of first and second signal contacts 51 and 52, and the terminal portions 51*d* and 52*d* of other pairs of first and second signal contacts 51 and 52 which are adjacent thereto, thereby preventing degradation in transmission.

Further, the row formed by the terminal portions 51*d* and 52*d* of the first and second signal contacts 51 and 52 and the terminal portions 53*d* of the ground contacts 53, and the two rows formed by the terminal portions 54*d* and 54*d*' of the contacts 54 and 54' are parallel to each other. This makes it possible to reduce the length of the housing 3 in the contact arranging direction C, and downsize the connector 1. Further, the terminal portions 54*d* of the contacts 54 and the terminal portions 54' of the contacts 54' are disposed in staggered arrangement in the contact arranging direction C. This makes it possible to shorten the dimension of part of the printed board 21 where the through holes 21*b* are provided, in the arrangement direction p.

Further, the terminal portions 51*d*, 52*d*, 53*d*, 54*d*, 54*d*' of the contacts 51, 52, 53, 54, 54' protrude out of the housing 3, and hence it possible to easily check the soldered states of the terminal portions 51*d*, 52*d*, 53*d*, 54*d*, 54*d*', and easily perform repair of the connector 1.

Further, since the disconnection prevention portions 54*f*, 54*f*' are secured to the respective associated recesses 34*a* of the holding portion 34 of the housing 3, it is possible to prevent the contact portions 54*a*, 54*a*' from wobbling.

Although the contacts 51, 52, 53 for high-speed transmission are employed as the first contacts, and the contacts 54, 54' for non-high-speed transmission are employed as the second contacts, the first contacts are not limited to the contacts for high-speed transmission, and similarly, the second contacts are not limited to the contacts 54, 54' for non-high-speed transmission.

Further, although the fixing portions 51*b*, 52*b*, 53*b* of the contacts 51, 52, 53 are embedded in the housing 3 by the so-called mold-in method, the fixing portions 51*b*, 52*b*, 53*b* may be fixed to the housing 3 by press-fitting them into the housing 3.

Further, although the terminal portions 51*d*, 52*d*, 53*d* for SMT are employed as the connection portions of the contacts 51, 52, 53, the connecting portions of the first contacts may be terminal portions to be inserted into through holed.

Furthermore, although the terminal portions 54*d*, 54*d*' to be inserted into through holed are employed as the connection portions of the contacts 54, 54' for non-high-speed transmission, the connecting portions of the contacts 54, 54' may be terminal portions for SMT.

It is further understood by those skilled in the art that the foregoing are the preferred embodiments of the present invention, and that various changes and modification may be made thereto without departing from the spirit and scope thereof.

What is claimed is:

1. A connector comprising:

a housing that is capable of being fitted to a mating housing of a mating connector; and a plurality of L-shaped contacts that are held by the housing, the plurality of L-shaped contacts including first contacts and second contacts, wherein each of the first contacts and the second contacts has a contact portion which is capable of being brought into contact with a mating contact of the mating connector, a connection portion which is connected to an object to be connected, and a fixing portion which is fixed to the housing, wherein the contact portions of the first contacts are arranged in at least one row in a contact arranging direction which is orthogonal to a connector fitting direction, wherein the contact portions of the second contacts are arranged in at least one row in the contact arranging direction, wherein the row formed by the contact portions of the first contacts and the row formed by the contact portions of the second contacts are parallel to each other, wherein the row formed by the contact portions of the first contacts is disposed upward in a direction of height of the housing which is orthogonal to both the connector fitting direction and the contact arranging direction, with respect to the row formed by the contact portions of the second contacts, wherein the connection portions of the first contacts are arranged in at least one row in the contact arranging direction, wherein the connection portions of the second contacts are arranged in at least one row in the contact arranging direction, wherein the row formed by the connection portions of the first contacts and the row formed by the connection portions of the second contacts are parallel to each other, wherein the row formed by the connection portions of the first contacts is disposed rearward in the connector fitting direction with respect to the row formed by the connection portions of the second contacts, wherein the fixing portions of the second contacts are disposed between the contact portions of the first contacts and the connection portions of the first contacts in the connector fitting direction, and are press-fitted in the housing along the direction of height of the housing, and wherein each of the connection portions of the first contacts has a planar shape of a surface-mounting type, and each of the connection portions of the second contacts has a pin shape of a through hole insertion type.

2. A connector as claimed in claim 1, wherein each of the connection portions of the first contacts protrudes out of the housing.

3. A connector as claimed in claim 1, wherein the housing has recesses formed therein, and the second contacts have engaging portions formed for engagement with the recesses, respectively.

4. A connector as claimed in claim 2, wherein the housing has recesses formed therein, and the second contacts have engaging portions formed for engagement with the recesses, respectively.

5. A connector as claimed in claim 1, wherein the first contacts are contacts for high-speed transmission, and the second contacts are contacts for non-high-speed transmission.

6. A connector as claimed in claim 2, wherein the first contacts are contacts for high-speed transmission, and the second contacts are contacts for non-high-speed transmission.

7. A connector as claimed in claim 5, wherein the contacts for high-speed transmission include pairs of signal contacts for high-speed transmission, and ground contracts for high-speed transmission, and wherein the connection portions of the pairs of signal contacts for high-speed transmission are disposed between the connection portions of ones of the ground contacts for high-speed transmission which are adjacent in the contact arranging direction.

8. A connector as claimed in claim 6, wherein the contacts for high-speed transmission include pairs of signal contacts for high-speed transmission, and ground contracts for high-speed transmission, and wherein the connection portions of the pairs of signal contacts for high-speed transmission are disposed between the connection portions of ones of the ground contacts for high-speed transmission which are adjacent in the contact arranging direction.

9. A connector as claimed in claim 7, wherein the connection portions of the contacts for non-high-speed transmission are in staggered arrangement in the contact arranging direction.

10. A connector as claimed in claim 8, wherein the connection portions of the contacts for non-high-speed transmission are in staggered arrangement in the contact arranging direction.

* * * * *